US008984921B2

(12) United States Patent
Köstermeier

(10) Patent No.: US 8,984,921 B2
(45) Date of Patent: Mar. 24, 2015

(54) DEVICE AND PROCESS FOR PRODUCING OR PROCESSING WORKPIECES FROM A PREFORM, IN PARTICULAR FOR INTEGRALLY FORMING INTERNAL PROFILES OR INTERNAL TOOTH SYSTEMS

(75) Inventor: Karl-Heinz Köstermeier, Rheda-Wiedenbrück (DE)

(73) Assignee: Repkon Machine and Tool Industry and Trade Inc. (TR)

( * ) Notice: Subject to any disclaimer, the term of this patent is extended or adjusted under 35 U.S.C. 154(b) by 878 days.

(21) Appl. No.: 13/056,358

(22) PCT Filed: Jul. 29, 2009

(86) PCT No.: PCT/EP2009/005491

§ 371 (c)(1),
(2), (4) Date: Jan. 28, 2011

(87) PCT Pub. No.: WO2010/012457

PCT Pub. Date: Feb. 4, 2010

(65) Prior Publication Data

US 2011/0126606 A1 Jun. 2, 2011

(30) Foreign Application Priority Data

Jul. 29, 2008 (EP) ..... 08013579

(51) Int. Cl.
*B21D 22/16* (2006.01)

(52) U.S. Cl.
CPC ..... *B21D 22/16* (2013.01)
USPC ..... 72/83; 72/85; 72/96

(58) Field of Classification Search
USPC ..... 72/80, 82–84, 86, 89, 95, 96, 370.01, 72/85
See application file for complete search history.

(56) References Cited

U.S. PATENT DOCUMENTS

| | | | | |
|---|---|---|---|---|
| 3,908,421 | A * | 9/1975 | Killian et al. | 72/82 |
| 6,205,832 | B1 * | 3/2001 | Kostermeier | 72/83 |
| 6,269,670 | B2 * | 8/2001 | Koestermeier | 72/85 |

FOREIGN PATENT DOCUMENTS

| | | |
|---|---|---|
| DE | 19722359 | 12/1998 |
| DE | 10062002 | 12/2001 |
| EP | 1004373 | 5/2000 |

OTHER PUBLICATIONS

International Preliminary Report on Patentability for PCT/EP2009/005491 dated Aug. 2, 2011.
Written Opinion of the International Searching Authority for PCT/US2009/005491 dated Aug. 2, 2011.
International Search Report and Written Opinion in Application PCT/EP2009/005491.

* cited by examiner

*Primary Examiner* — Debra Sullivan
(74) *Attorney, Agent, or Firm* — Bourque and Associates, PA

(57) ABSTRACT

A device for manufacturing or processing work pieces consists of a preform (4.1), with a mandrel (1*a*) that is supported rotatably and parallel to a longitudinal axis (x) of the device, an associated chuck (1*b*) for clamping the preform (4.1) as well as a spindle sleeve (2*a*) that can be coupled with the mandrel (1*a*) and can be moved along the longitudinal direction (x), and with a forming unit (3) for forming the preform (4.1). The chuck (1*b*) is designed in a rotational fashion in relation to the mandrel (1*a*).

19 Claims, 6 Drawing Sheets

Schnitt: A - A

Schnitt: B - B
3a
3a'
3a''
3c
1b
1c
1d
1e
4.2
4a
3
A
B
x
z
u

DEVICE AND PROCESS FOR PRODUCING OR PROCESSING WORKPIECES FROM A PREFORM, IN PARTICULAR FOR INTEGRALLY FORMING INTERNAL PROFILES OR INTERNAL TOOTH SYSTEMS

TECHNICAL FIELD

The invention relates to a device for manufacturing or processing pieces derived from a preform, and in particular, to a device for molding internal and/or external profiles or internal toothings on a preform.

BACKGROUND INFORMATION

A prior art device is described in EP 1004 373 B1. Such devices are used to mold internal toothing onto work pieces, in particular rings for planetary gearing. By setting press rollers against the preform, material is displaced from said preform against the negative form of the spinning mandrel. In this process, the acting forces act on the outer toothing of the spinning mandrel such that the teeth can break. The prior art recommends providing a spacer ring made of moldable material at a distance from the free end of the spinning mandrel. In the forming process, the moldable spacer ring adapts to the outer profile of the spinning mandrel. Thus, the spacer ring assumes at least in part the forces that come into existence during the forming process.

The disadvantage is that a spacer ring and a parallel key are always required, complicating the arrangement. In addition, high forming temperatures occur that significantly increase the time for forming and manufacturing the work pieces.

SUMMARY OF THE INVENTION

According to the invention, not only can the chuck be moved together with the mandrel but is also radially pivot-mounted, i.e., parallel to, or identical with the longitudinal axis of the device according to the invention. Due to the material flowing from the preform because of the pressure, the material not only flows axially due to the rotation of the mandrel but the material flow also has a radial or tangential component, respectively. Based on the rotatability of the chuck, the forces that act radially onto the chuck and are caused by the displaced material do not lead to overstressing of the chuck (and potential toothing located on the chuck) but instead to a movement of the chuck in the direction of the acting forces. Thus, the chuck can always yield under excessive pressure such that damage, e.g., the breaking of teeth, can be avoided. It has also been shown that due to the invention the friction in the radial direction of the mandrel is reduced significantly, thus generating significantly lower forming temperatures than with the traditional methods such that forming can be accomplished much faster and more work pieces can be completed in the same amount of time.

It is important to note that the present invention is not intended to be limited to a device or method which must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

BRIEF DESCRIPTION OF THE PRESENTED DRAWINGS

These and other features and advantages of the present invention will be better understood by reading the following detailed description, taken together with the drawings wherein.

Figures 10, 11:
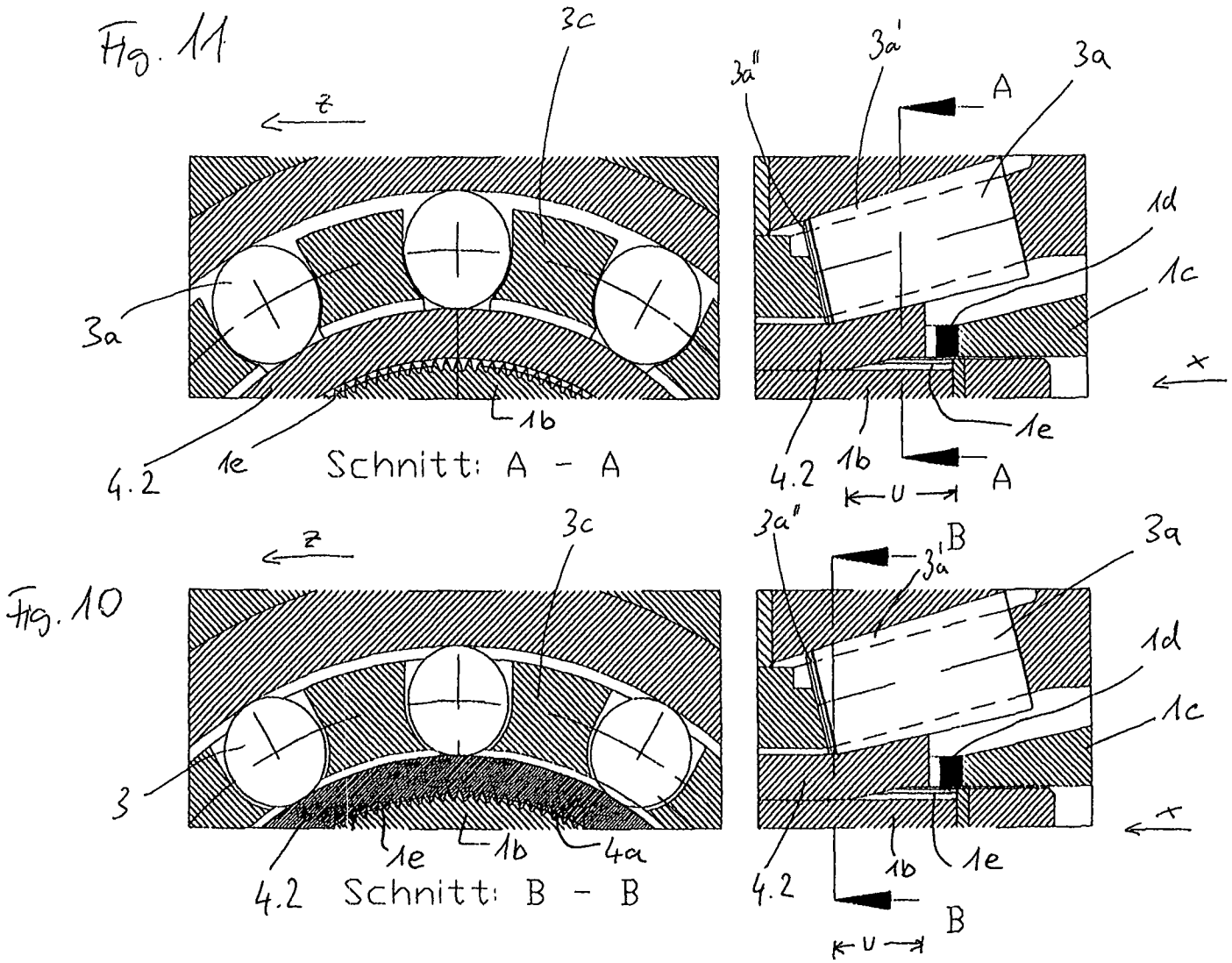
FIG. 10 shows a cross-section parallel to the cross-axis z of the machine (left) through a portion of the preform and the forming device along a section line B-B and a section along the longitudinal axis x of the machine (right)
FIG. 11 shows a cross-section parallel to the cross-axis z of the machine (left) through a portion of the preform and the forming device along a section line A-A and a section along the longitudinal axis x of the machine (right)
Figure 13:
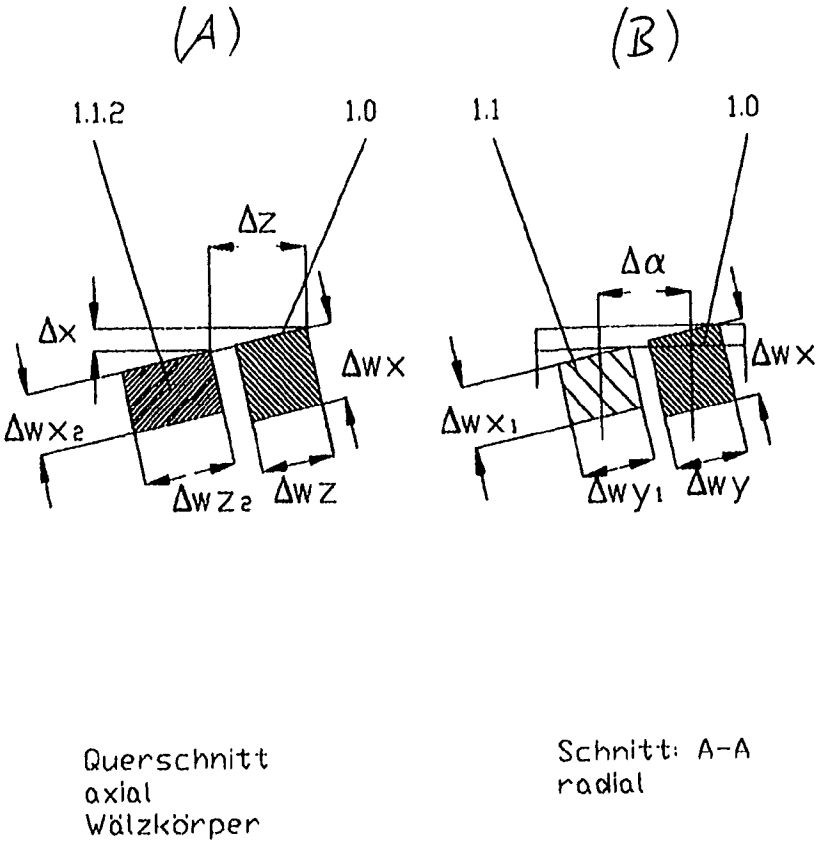
Figure 12:
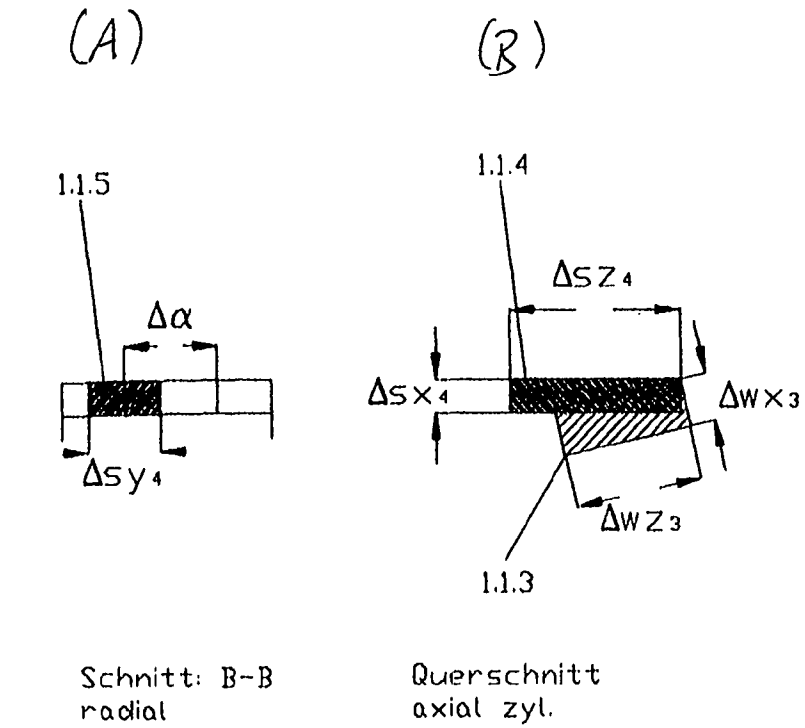

FIGS. 12 (A) and (B) show schematically the radial or axial movements/formings of a material volume in the region shown in FIG. 10; and FIGS. 13 (A) and (B) show schematically the radial or axial movements/formings of a material volume in the region shown in FIG. 11.

DETAILED DESCRIPTION OF THE PREFERRED EMBODIMENTS

The device according to the invention presented in FIGS. 1 to 6 includes a main spindle box 1 with a spindle drive. A tool device 1*c* is flanged to the main spindle 1 and is equipped with a spur-cut catch element 1*d* with a receiving hole for the chuck 1*b* and a mandrel 1*a*.

Connected to the main spindle 1 is a movable mandrel 1*a* which is supported in an axially movable fashion in the direction of the machine or longitudinal axis x. Relative to this, the direction perpendicular to the plotting plane and perpendicular to the longitudinal machine axis x is also named the cross machine axis z. As a rule, the movable mandrel 1*a* is actuated by a hydraulic cylinder (not shown). Located at the end of the mandrel 1*a*, which faces a spindle sleeve 2*a* that is provided at a tailstock 2, is a profile 1*a*' in which the tool clamping device 2*a*' of the spindle sleeve 2*a* can engage. This secures and clamps the preform 4.1 in combination with the spindle sleeve 2*a* and the mandrel 1*a* radially such that one unit is created that can be moved axially and rotated around the longitudinal machine axis x.

In this situation, the chuck 1*b* can rotate relative to the preform 4.1 as long as it is acted upon by a force acting from the outside, such as is the case, for example, when the chuck 1*b* includes helical gearing (cf. FIGS. 10 and 11).

Figure 7:
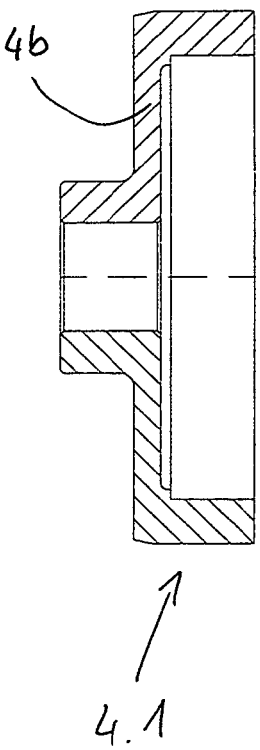
FIG. 7 shows a cross-sectional view of a preform.
Figure 8:
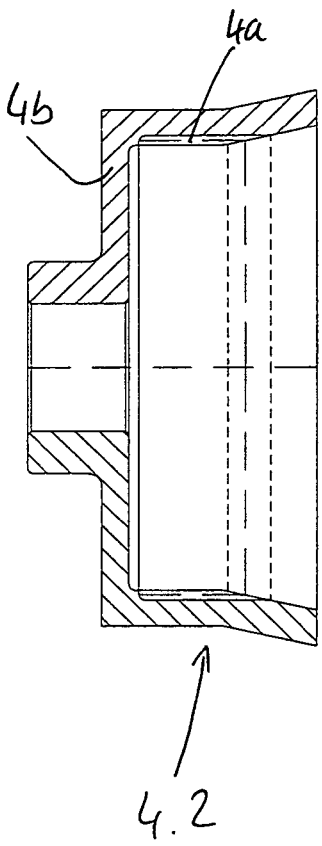
FIG. 8 shows a cross-sectional view of a partially formed preform.
Figure 9:
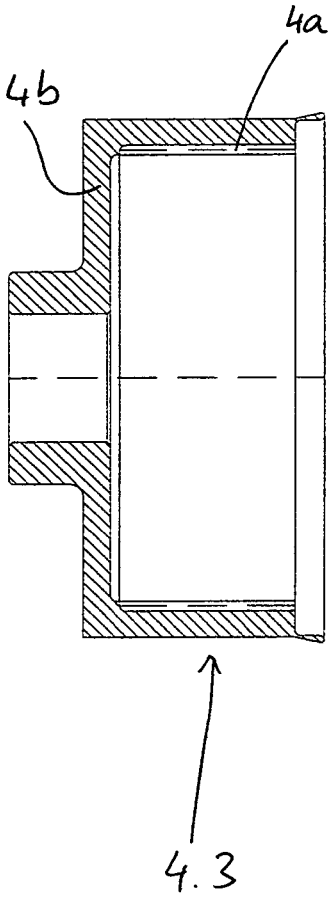
FIG. 9 shows a cross-sectional view of the work piece after the forming procedure.

The chuck 1*b*, which is provided at the outside diameter with a negative profile 1*b* of the inner profile 4*a* that is to be formed on the preform 4.1, is axially secured and rotatably attached on the movable mandrel 1*a*. If necessary, toothing can be provided at the face side on the side of the chuck 1*b* that is facing the preform 4.1 and is then pressed against the wall 4*b* (cf. FIGS. 7, 8 and 9) of the preform 4.1 by an axial pressure via the mandrel 1*b* (for example using a hydraulic cylinder).

The forming unit 3 is arranged axially movable in the center of the longitudinal machine axis x around which orbit the rolling elements 3*a* and a cage 3*c*. The rolling elements 3*a*, guided in their cage 3*c*, orbit around the preform 4.1 upon contact with the same in a planet-like manner, i.e., during the forming procedure, the rolling elements 3*a* orbit with the cage 3*c* around the preform 4.1, 4.2, which rotates around the longitudinal machine axis x, or parallel to it, respectively.

The rolling elements or forming rollers 3*a* are preferably designed as rolling elements with a tapered surface 3*a*', the smaller diameter of which is provided with a radius adapted to the forming process and with a runout bevel 3*a*". All rolling elements 3*a* are kept inside the orbiting cage 3*c*. The cage 3*c* is supported centered in a housing 3*b*, which is retained axially in a specified position via an axial positioning device 3*d*, in the example shown in the form of a hydraulic cylinder. With this axial positioning, outside diameters of the preform to be formed can be adjusted based on the orbiting rolling elements 3*a* to a specified diameter range such that various diameters can be formed in a preform 4.1.

After successful forming, the cage 3*c* is moved by the positioning device 3*d* against the forming direction, such that the rolling elements 3*a* are set to a greater forming diameter, such that upon retracting of the forming unit 3 into the starting position (FIGS. 1 and 6), the diameter of the formed work piece 4.2 is not affected. For purposes of heat dissipation and lubrication of the forming unit 3, coolant inlets are arranged preferably in the area between the housing 3*b* of the rolling elements 3*a* and the cage 3*c*, such that a coolant and a lubricant can flow through the forming unit 3 during the forming procedure.

The tailstock 2 (in FIGS. 1 through 6 only indicated by an end region surrounding the spindle sleeve 2*a*) with the spindle sleeve 2*a* and the tool clamping device 2*a*' are also situated in the center of the longitudinal machine axis x. The clamping process of the work piece is as follows:

The preform 4.1 is pushed onto the advanced mandrel 1*a* of the main spindle side. The spindle sleeve 2*a* of the tailstock 2 travels to the loading position, FIG. 1. The collet 2*a*' is extended using a hydraulic cylinder such that the profile 1*a*', which is worked into the movable mandrel 1*a*, is located in the area of the collet 2*a*'. Using the other advancing spindle sleeve 2*a*, the collet 2*a*' closes synchronously, such that the preform 4.1 is pressed via the mandrel 1*a* with the chuck 1*b* against the contact surface of a pressing ring 2*a*" of the spindle sleeve 2*a*. This creates a closed unit consisting of spindle sleeve 2*a*, mandrel 1*a*, preform 4.1 and chuck 1*b*, FIG. 2.

In this case, the area of the preform that is facing the main spindle side is free, such that this unit advances through the spindle sleeve 2*a* so far until this area is blocked axially by the spur-cut catch unit 1*d*, 1*c* of the main spindle and is thus tensioned by a high pressure. This pressure must be sufficiently high such that the preform 4.1 is rotated along through the catch unit 1*d*, 1*c* during the rotation at the load acting on the preform 4.1 during forming.

In detail, the forming procedure is as follows: After the preform 4.1 is clamped, the unit travels in the direction of the catch 1*d* of the main spindle, such that the preform 4.1 is pressed against the catch 1*d* upon contact with the latter.

Figures 1, 2:
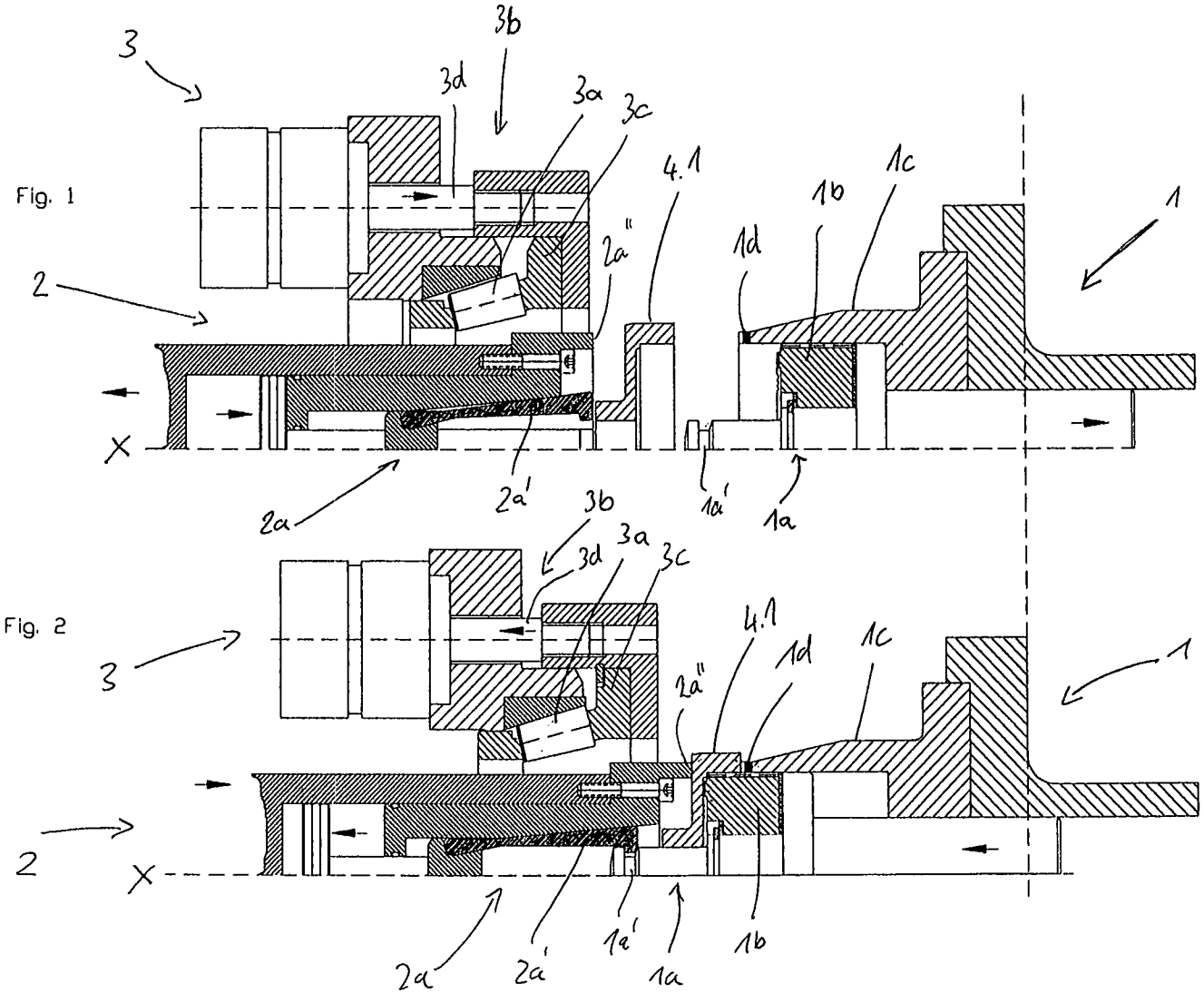
FIG. 1 shows a cross-sectional view through device according to the invention in a longitudinal section when clamping the preform.
FIG. 2 shows a cross-sectional view through the device according to the invention with the chucked perform.
Figure 3:
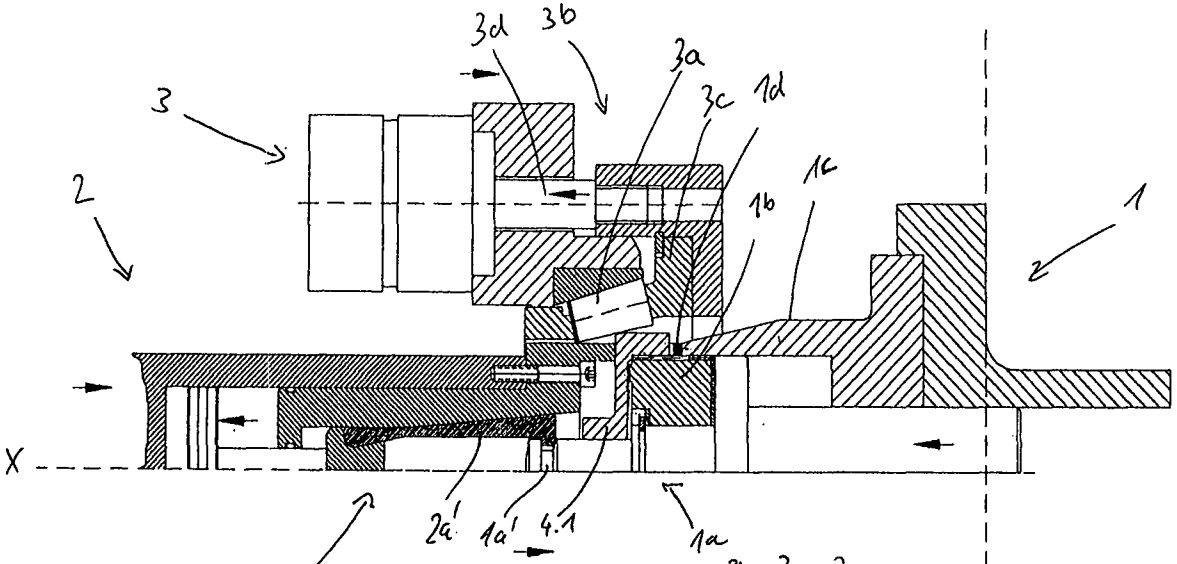
FIG. 3 shows a cross-sectional view through the device according to the invention directly prior to forming.
Figure 4:
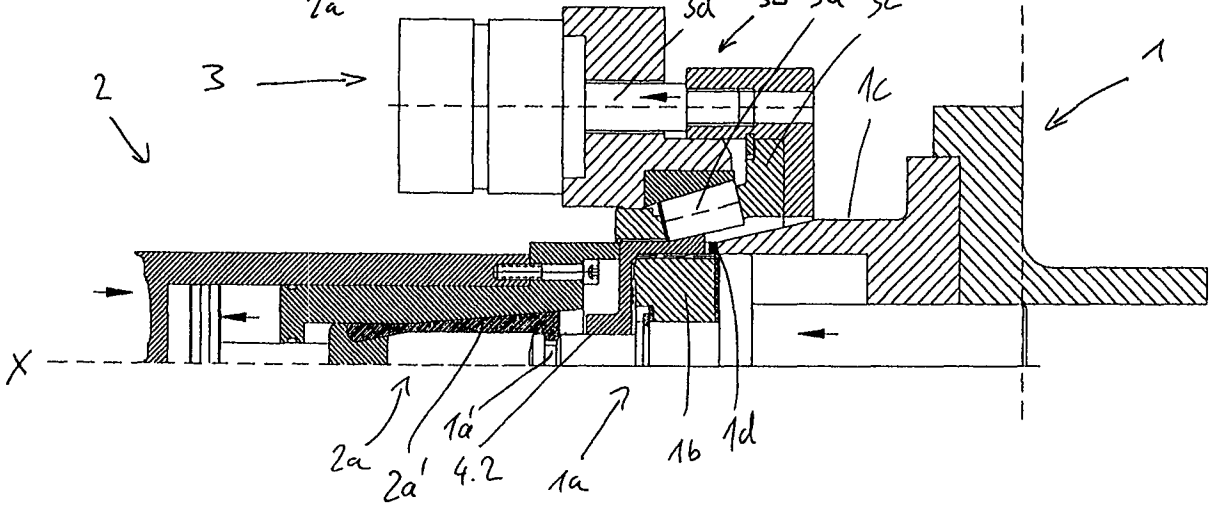
FIG. 4 shows a cross-sectional view through the device according to the invention with a partially processed preform.

After turning on the main spindle, the catch 1*d* and the unit consisting of spindle sleeve 2*a*, mandrel 1*a*, preform 4.1 and chuck 1*b* will rotate such that the forming unit can advance axially to the contact of the rolling element 3*a* with the preform 4.1, FIG. 3. Through contact with the preform 4.1, the rolling elements 3*a* automatically assume their position and in their cage 3*c* orbit around the preform 4.1 in a planet-like manner. With an increasing advance pressure, the material of the preform 4.1 is plasticized by the rolling elements 3*a* in the contact region between preform 4.1 and rolling elements 3*a* and intrudes into the empty spaces between the preform 4.1, 4.2 and the chuck 1*b*, FIG. 4, FIG. 10 and FIG. 11.

At the same time several forming processes proceed, which shall now be explained based on a fictitious material particle.

The assumed positions of the particles are each shown in the sections A-A and B-B as well as in the associated cross-sections of FIGS. 12 and 13, respectively.

The individual states of the material particle whose volume in the initial state is wx*wy*wz, whereby wx, wy, wz specify the extension of the particle in the three Cartesian directions, shall be defined as follows:

1.0 Assumed material particle wx*wz*wy 1.1 Deformation of the particle in the plane x,y from wx*wy to $wx_1$*$wy_1$ in the radial and tangential direction upon rotation of the rolling element 3*a* by the angle $\Delta\alpha$ 1.1.2 Deformation of the particle in the x,z plane from wx*wz to $wx_2$*$wz_2$ in the axial direction in the area of the rolling element 3*a* at an axial advance $\Delta z$ in the beveled area of the rolling element 3*a*.

1.1.3 Deformation of the particle $wx_1$*$wz_2$ to $wx_3$*$wz_3$ in the axial direction in the area of the rolling element 3*a*.

1.1.4 Deformation of the particle $wx_3$*$wz_3$ to $sx_4$*$sz_4$ in the axial direction after leaving the area of the rolling element.

1.1.5 Deformation of the particle $sx_4$*$sy_4$ in the radial and tangential direction upon rotation of the rolling element 3*a* by the angle $\Delta\alpha$.

The following occurs during this forming process: The orbiting rolling elements 3*a* plastify in the contact region with the preform 4.1 the material in the tangential, radial and axial direction at a simultaneous axial advance in the direction of the catch 1*d* of the main spindle.

The contact region of the rolling elements 3*a* with the preform 4.1 forms a forming zone U, cf. FIGS. 12 and 13. In this forming zone U, the platicized material enters into the free space between the preform 4.1 and the chuck 1*b*, fills the profile 1*e* in the chuck 1*b*, FIG. 10. In the process, the material is supported by the axially blocking area of the preform 4.2 between the forming zone U and the catch 1*d*. This causes the excess material to move axially the freely-movable, coupled unit consisting of mandrel 1*a*, chuck 1*b*, clamping device 2*a*', spindle sleeve 2*a* and the area of the preform 4.2 that is located outside and behind the forming zone U.

The axial length $\Delta s$ formed in the process with the newly formed outside diameter moves in the direction of the tailstock 2. It results from the remaining volume with the newly formed cross-section, which remained from the displaced volume minus the volume that protruded into the free space.

In the area of the forming zone U, the rolling elements 3*a* displace the material in the radial and tangential direction. Thus, the material rotates within the preform 4.2 in the area of the forming zone U relative to the part of the preform 4.2 that is held by the catch 1*d* outside of the forming zone U, because due to the radial reduction of the outside diameter, the material amount must be situated on a smaller outside diameter during the forming process. This results in an overlaid relative rotation of the material in relation to the actual rotation of the preform 4.2. The size of the rotational angle of the relative rotation is dependent on the reduction of the cross-section of the work piece. Thus, the area of the preform 4.2 that is located between the spindle sleeve 2*a* and the forming zone U in the preform must rotate.

If the mandrel 1*a*, on which the preform 4.2 is deep-drawn, is connected turn-proof to the catch 1*d* of the main spindle, the material must rotate relative in the tangential direction onto the rotating mandrel 1*a*. If the mandrel 1*a* exhibits a radial profile (for example, like the profile 1*c* on the chuck 1*b*), the result is an increasing rotational tension within the profile 1*c* up to the point of its fracture. The rotational tensions are compensated by the co-rotation of the chuck 1*b* due to the fact that chuck 1*b* is rotationally supported by the mandrel 1*a*.

Figure 5:
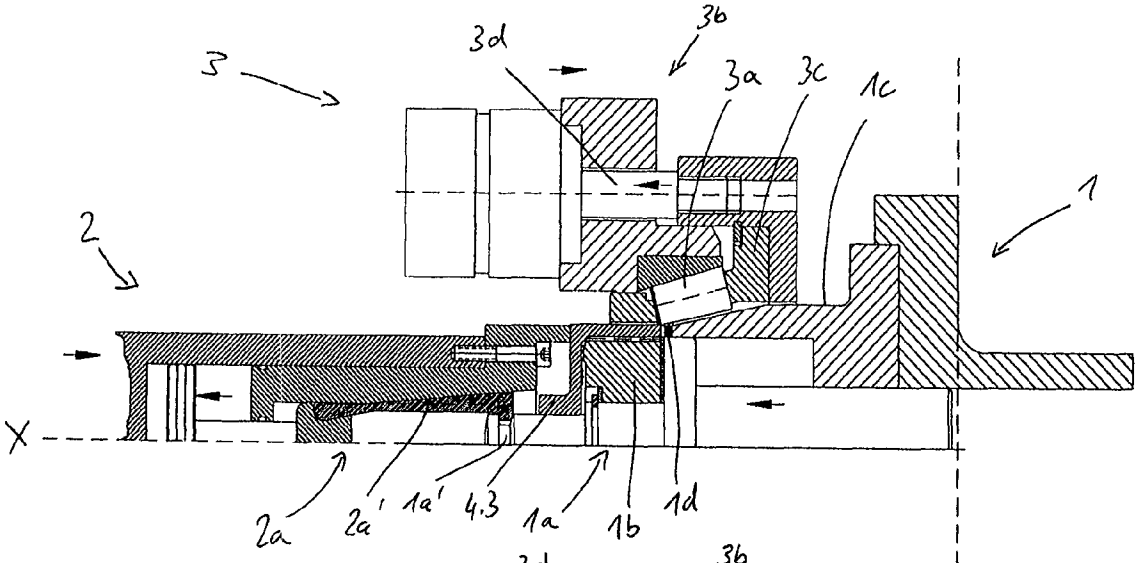
FIG. 5 shows a cross-sectional view through the device according to the invention at the end of the forming procedure.
Figure 6:
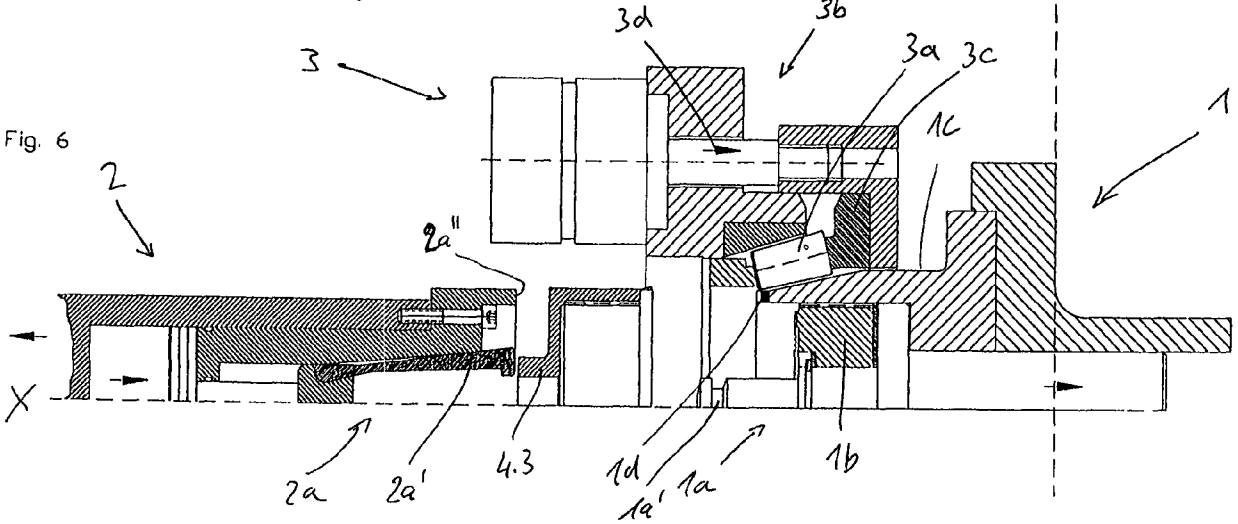
FIG. 6 shows a cross-sectional view through the preform according to the invention when removing the finished work piece that has been made from the preform.

After the forming unit has formed the preform 4.1, 4.2 into a work piece 4.3, FIG. 5, the cage 3*c* is moved axially to a position, in which the rolling elements 3*a* can yield radially. With this setting, the forming unit can retract. As soon as the main spindle stops, the movable unit consisting of spindle sleeve 2*a*, mandrel 1*a*, preform 4.1 and chuck 1*b* is decoupled and the tail stock spindle sleeve 2*a* is retracted with the opened clamping unit 2*a*', FIG. 6. The formed work piece, which is located on the chuck 1*d*, is stripped off the chuck 1*b* by the catch 1*d*, into which the retracting mandrel 1*a* plunges with the chuck 1*b*.

The present invention is not intended to be limited to a device or method which must satisfy one or more of any stated or implied objects or features of the invention. It is also important to note that the present invention is not limited to the preferred, exemplary, or primary embodiment(s) described herein. Modifications and substitutions by one of ordinary skill in the art are considered to be within the scope of the present invention, which is not to be limited except by the allowed claims and their legal equivalents.

The invention claimed is:

1. A device for generating or processing work pieces from a preform (4.1), the device having an axially movable mandrel (1*a*) which is mounted so that it can be rotated about a longitudinal axis (x) of the device and displaced axially parallel to and along the longitudinal axis (x), and a chuck (1*b*) for tensioning the preform (4.1) and a sleeve (2*a*) which can be coupled to the mandrel (1*a*) and is mounted displaceably along the longitudinal direction (x) and a shaping unit (3) for shaping the preform (4.1), wherein the preform (4.1) can be axially and radially fixed and tensioned in a composite unit comprising the sleeve (2*a*) and the mandrel (1*a*) so that a closed unit comprising the sleeve (2*a*), the preform (4.1), the mandrel (1*a*) and the chuck (1*b*) is formed, wherein the device comprises a catch element (1*d*), wherein the shaping unit (3) can be moved in an axial direction towards the catch element (1*d*) so that the preform (4.1) is pressed upon contact with the catch element against the catch element (1*d*), characterized in that the mandrel (1*a*) and catch element (1*d*) are coupled together to a main spindle (1) and prevented from rotational movement independent of one another, and wherein the chuck (1*b*) is axially fixed with the axially movable mandrel (1*a*), wherein the chuck (1*b*) is configured for rotational movement about said longitudinal axis (x) independent of and in relation to any rotational movement of said mandrel, and wherein the chuck (1*b*) is configured for rotational movement about said longitudinal axis (x) in relation to said preform (4.1).

2. The device according to claim 1, characterized in that the chuck (1*b*) has a negative form (1*e*) which corresponds to a positive form (4*a*) to be formed on the preform (4.1).

3. The device according to claim 1, characterized in that the mandrel (1*a*) is assigned to a headstock (1) and which is freely movable axially and tangentially in a tool housing (1*c*).

4. The device according to claim 3, characterized in that the headstock (1) comprises a drive for rotation and/or axial displacement of the preform (4.1) via the tool housing (1*c*) and the catch element (1*d*) arranged thereon facing the sleeve (2*a*).

5. The device according to claim 1, characterized in that the sleeve (2*a*) is assigned to a tailstock (2) and comprises a pressing ring (2*a*").

6. The device according to claim 5, characterized in that the sleeve (2*a*) of the tailstock (2) is mounted so as to be rotationally and/or axially displaceable.

7. The device according to claim 1, characterized in that the shaping unit (3) comprises at least two rolling bodies (3*a*).

8. The device according to claim 7, characterized in that the shaping unit (3) is arranged to be axially displaceable.

9. The device according to claim 7, characterized in that the setting angle of the rolling body (3*a*) can be varied.

10. The device according to claim 7, characterized in that the rolling bodies (3*a*) are arranged and mounted so that they can be driven to circulate over the preform (4.1).

11. A method for generating or processing work pieces from the preform (4.1) by means of a device according to claim 1, wherein the preform (4.1) located on the chuck (1*b*) axially fixed and rotationally mounted on the axially movable mandrel (1*a*) is shaped by means of the shaping unit (3), wherein the shaping of the preform (4.1) is brought about by means of a material flow arising via a pressure between the shaping unit (3) and the preform (4.1), wherein the chuck (1*b*) follows, during the shaping, a movement in a direction of the flowing material, wherein the material flow obtains a tangential component, characterized in that through the chuck (1*b*) mounted rotationally on the mandrel (1*a*), the rotation stresses are compensated by entraining the chuck, whereby the chuck (1*b*) moves axially in a direction of the forces exerted.

12. The method according to claim 11, characterized in that the chuck (1*b*) follows, during the shaping, the axial and tangential movement directions of the flowing material.

13. The method according to claim 11, characterized in that before the shaping the preform (4.1) is initially received by the axially movable mandrel (1*a*) by means of an advancing movement (1*e*), the preform (4.1) is then pressed through an axially advancing sleeve (1*a*) against a tool housing (3*c*) so that a coupled unit comprising chuck (1*b*), mandrel (1*a*), preform (4.1) and sleeve (2*a*) is produced.

14. The method according to claim 13, characterized in that the coupled unit follows the axial and tangential movement directions of the flowing material during shaping.

15. The method according to claim 11, characterized in that the chuck (1*b*) is drawn via the axially movable mandrel (1*a*) through a clamping device (2*a*') against an inner side of the preform (4.1) so that the chuck (1*b*) comes into direct contact with a region of the preform (4.1) not to be shaped.

16. The method according to claim 13, characterized in that the coupled unit is set in rotation.

17. The method according to claim 11, characterized in that the preform (4.1), before shaping, is tensioned to be radially and axially non-displaceable in relation to the chuck (1*b*) mounted rotationally on the axially movable mandrel (1*a*).

18. The method according to claim 11, characterized in that the shaping unit (3) comprises rollers (3*a*) which are placed on the preform (4.1) to be processed.

19. The method according to claim 11, characterized in that the shaping unit (3) is moved upon pressure of the rollers against the preform (4.1) relative thereto in the longitudinal direction (x) thereof.

* * * * *